United States Patent [19]

Corcoran et al.

[11] 4,157,133

[45] Jun. 5, 1979

[54] ELEVATOR SYSTEM

[75] Inventors: Harold L. Corcoran, Lyndhurst, N.J.; Kenneth M. Eichler, North Versailles; Alan F. Mandel, Scott Township, Allegheny County, both of Pa.

[73] Assignee: Westinghouse Electric Corp., Pittsburgh, Pa.

[21] Appl. No.: 899,196

[22] Filed: Apr. 24, 1978

[51] Int. Cl.[2] ..... B66B 3/00

[52] U.S. Cl. ..... 187/29 R; 340/19 R

[58] Field of Search ..... 187/29; 340/19-21

[56] References Cited

U.S. PATENT DOCUMENTS

| | | | |
|---|---|---|---|
| 3,388,376 | 6/1968 | Magee | 187/29 X |
| 3,428,148 | 2/1969 | Jacobs | 187/29 |
| 3,973,648 | 8/1976 | Hummert et al. | 187/29 |
| 4,002,973 | 1/1977 | Wiesendanger et al. | 187/29 X |
| 4,026,389 | 5/1977 | Magee | 187/29 |

*Primary Examiner*—Gene Z. Rubinson
*Assistant Examiner*—W. E. Duncanson, Jr.
*Attorney, Agent, or Firm*—D. R. Lackey

[57] ABSTRACT

An elevator system which includes a display of dynamic system conditions, and a building floor security arrangement which cooperates with the elevator system and display to take cars in and out of service, and to selectively control access to the floors of the building. The display visually confirms each change correctly initiated by the security arrangement. Multiple display modes may be selectively activated to either decode an input to the display and display an associated legend, or to examine the integrity of the wiring associated with the input.

16 Claims, 13 Drawing Figures

ROM MAP

| LOOK UP TABLE | | | | | | | | |
|---|---|---|---|---|---|---|---|---|
| FLOOR | DISABLE CODE | | | | ENABLE CODE | | | |
| | SWITCH NO. | | | | SWITCH NO. | | | |
| | 4 | 3 | 2 | 1 | 4 | 3 | 2 | 1 |
| B | 0110 | 0110 | 0110 | 0100 | 1000 | 0000 | 1000 | 0001 |
| 1 | 0101 | 1001 | 0000 | 1000 | 0000 | 0010 | 0101 | 0001 |
| 2 | 0001 | 1000 | 0100 | 0101 | 1000 | 0010 | 0101 | 1001 |
| • | • | • | • | • | • | • | • | • |
| • | • | • | • | • | • | • | • | • |
| • | • | • | • | • | • | • | • | • |
| 24 | 0110 | 0001 | 0010 | 0110 | 0101 | 1000 | 0011 | 0101 |
| TE | 0111 | 0000 | 0111 | 0000 | 0000 | 0101 | 0000 | 0100 |

RAM MAP

FLOOR CUT-OUTS

| ADDRESS-LEFT BIT | | | | | | | | DATA-LEFT BIT | | | | | | | | ADDRESS-RIGHT BIT | | | | | | | | DATA-RIGHT BIT | | | | | | | |
|---|---|---|---|---|---|---|---|---|---|---|---|---|---|---|---|---|---|---|---|---|---|---|---|---|---|---|---|---|---|---|---|
| ROW | | | | COLUMN | | | | M | ROW | | | | COLUMN | | | ROW | | | | COLUMN | | | | M | ROW | | | | COLUMN | | |
| A8 | A7 | A6 | A5 | A4 | A3 | A2 | A1 | A0 | D7 | D6 | D5 | D4 | D3 | D2 | D1 | D0 | A8 | A7 | A6 | A5 | A4 | A3 | A2 | A1 | A0 | D7 | D6 | D5 | D4 | D3 | D2 | D1 | D0 |
| 1 | 0 | 1 | 1 | 1 | 1 | 0 | 0 | 1 | 0 | 1 | 0 | 1 | 1 | 0 | 1 | 0 | 1 | 0 | 1 | 1 | 1 | 1 | 0 | 1 | 0 | 0 | 1 | 0 | 0 | 0 | 1 | 0 | 1 |

ELEVATOR SYSTEM

BACKGROUND OF THE INVENTION

1. Field of the Invention

The invention relates in general to elevator systems, and more specifically to elevator systems which include a visual display for displaying certain dynamic system parameters.

2. Description of the Prior Art

It is conventional in elevator systems having a plurality of elevator cars to include a visual display, such as a traffic director station in the lobby. The visual display indicates such dynamic system parameters as the locations of the elevator cars, and the locations of currently registered by unanswered up and down hall calls. It is also conventional to generate floor enable signals to prevent the elevator cars from stopping at selected floors for security purposes. Such floor enable signals, for example, may be generated by keyed switches, one for each floor to be selectively removed from elevator service. The floor enable signals may prevent a car from answering hall calls, or car calls, or both, according to the security requirements of the associated building.

In the prior art, the visual display and the building floor security functions are isolated functions with no interrelationship or dependence upon one another. Copending application Ser. No. 796,497, filed May 12, 1977, entitled "Elevator System", discloses a new and improved elevator system which includes a display having the capability of also displaying various building messages. For example, it discloses being tied into a building security system to the extent of indicating when a predetermined door in the building has been opened, or when a predetermined fire or smoke alarm has been tripped.

Copending application Ser. No. 510,940, filed Sept. 30, 1974, entitled "Elevator Bank Simulation System", discloses an interactive, real time elevator bank simulator which simulates the operation of an elevator system, and enables an operator to interact with the system by entering calls, etc.

U.S. Pat. No. 3,973,648 entitled "Monitoring System For Elevator Installation" discloses a display which may be used for off-site monitoring, traffic study, and/or trouble-shooting of elevator installations. Commands for the elevator system may be entered on the display, and if the command is actually received by the elevator system, the display confirms this fact. The above-mentioned copending applications and U.S. patent are all assigned to the same assignee as the present application.

SUMMARY OF THE INVENTION

Briefly, the present invention is a new and improved elevator system which includes a plurality of elevator cars mounted in a building to serve the floors therein. The elevator system also includes a visual display for displaying predetermined dynamic parameters of the elevator system. A building floor security arrangement cooperates with the elevator system and visual display to control access to the floors of the associated building. The building floor security arrangement may also be used to take cars in and out of service, change dispatching modes, and the like. The building floor security arrangement includes means for entering a predetermined code in the form of open or closed contacts, to remove a selected floor from elevator service, or to return a selected disabled floor to elevator service. The visual display displays the currently "cutout" floors during the process of removing or adding floors to elevator service, with the correct administration of the code and security procedure being visually confirmed on the display. Predetermined different codes would be used to take cars in and out of service, change dispatching modes, etc. The display may also monitor the contact conditions of a large number of external contacts, in addition to those associated with the floor security function. In a first display mode, the condition of each contact is decoded to provide a predetermined display on the visual display. In a second display mode, the condition of each contact is visually displayed, which mode is useful in testing the integrity of the external wiring during initial system test, and subsequent servicing thereof.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1A:
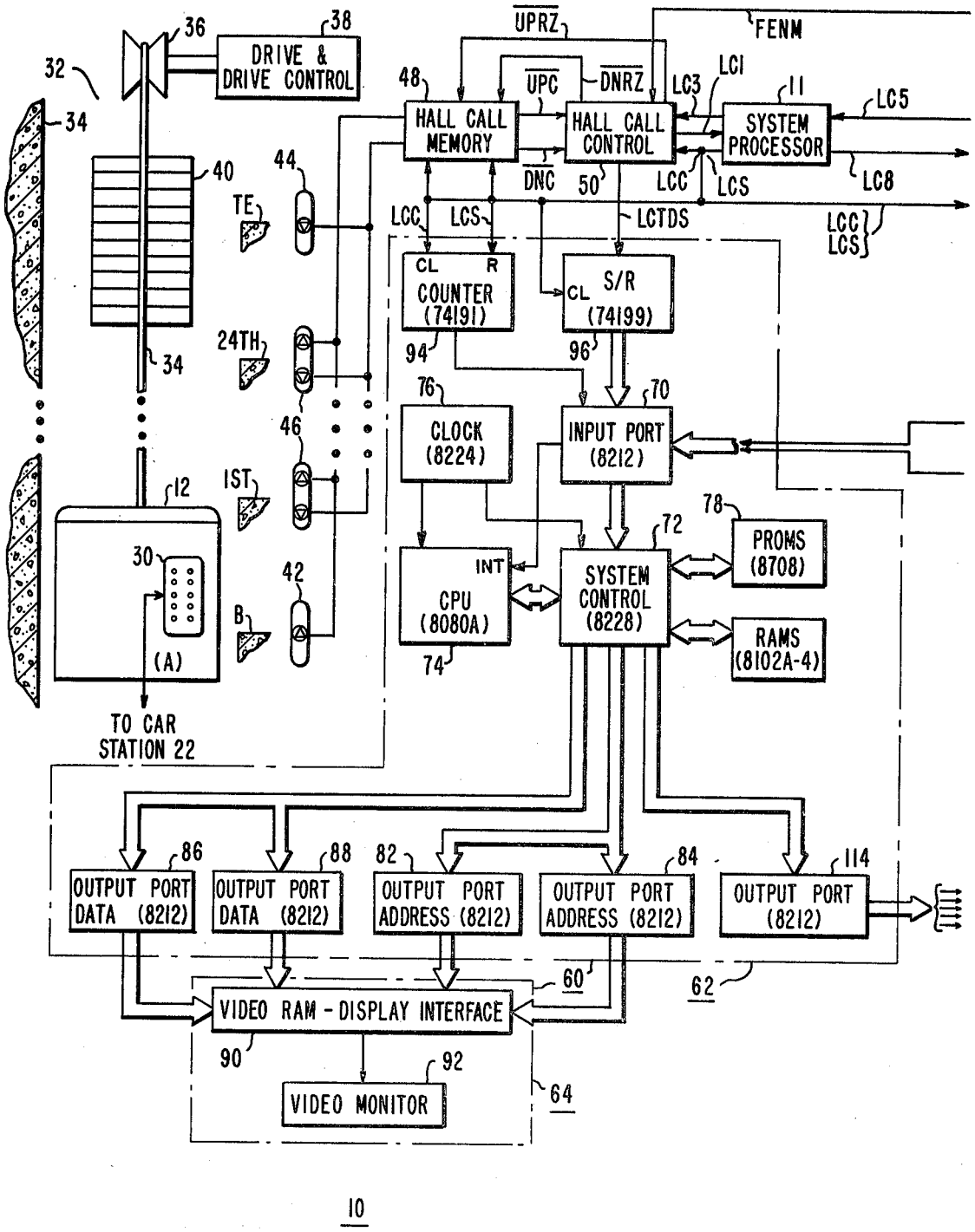
FIGS. 1A and B is a partially schematic and partially block diagram of an elevator system constucted according to the teachings of the invention.
Figure 1B:
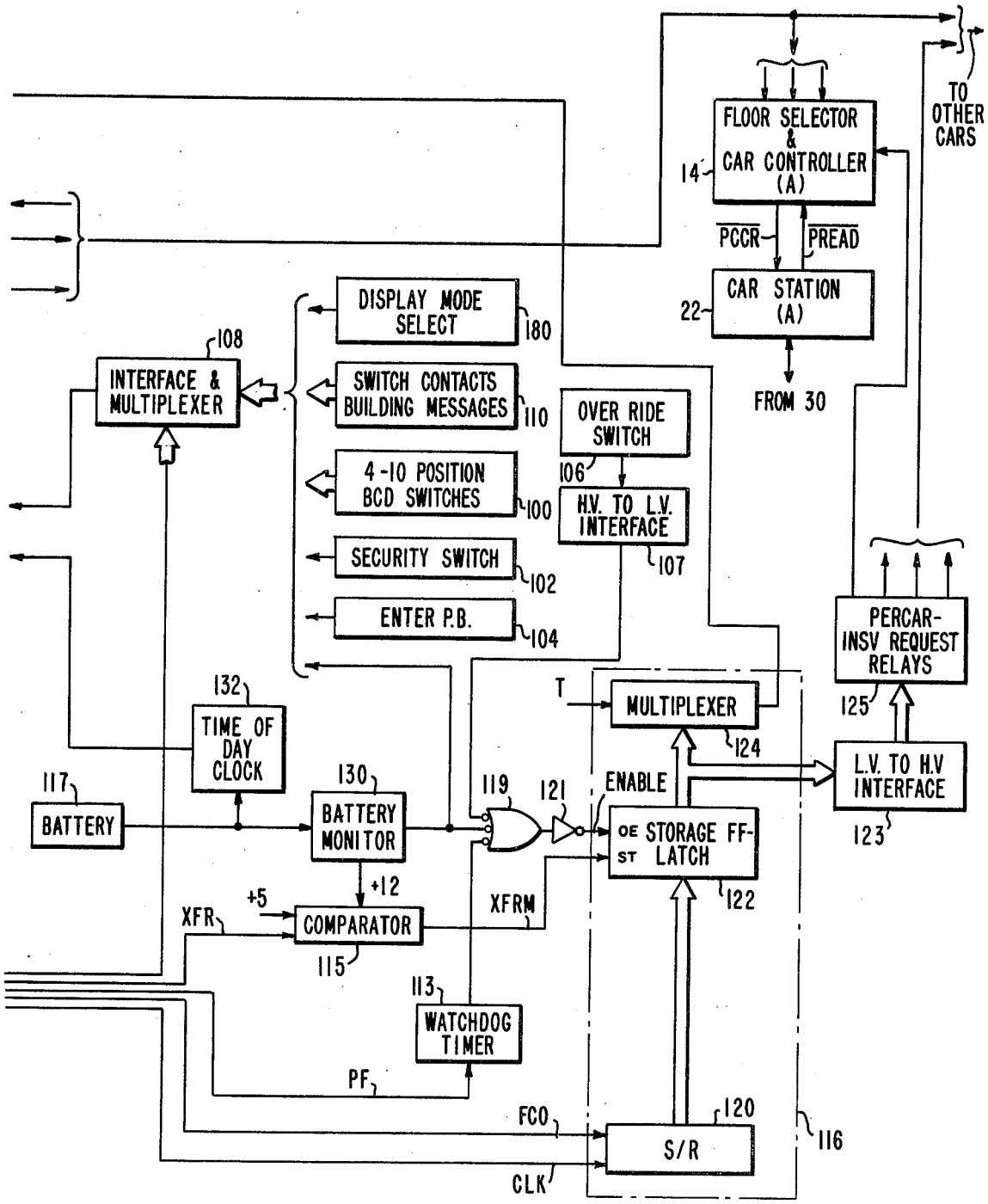
Figure 2:
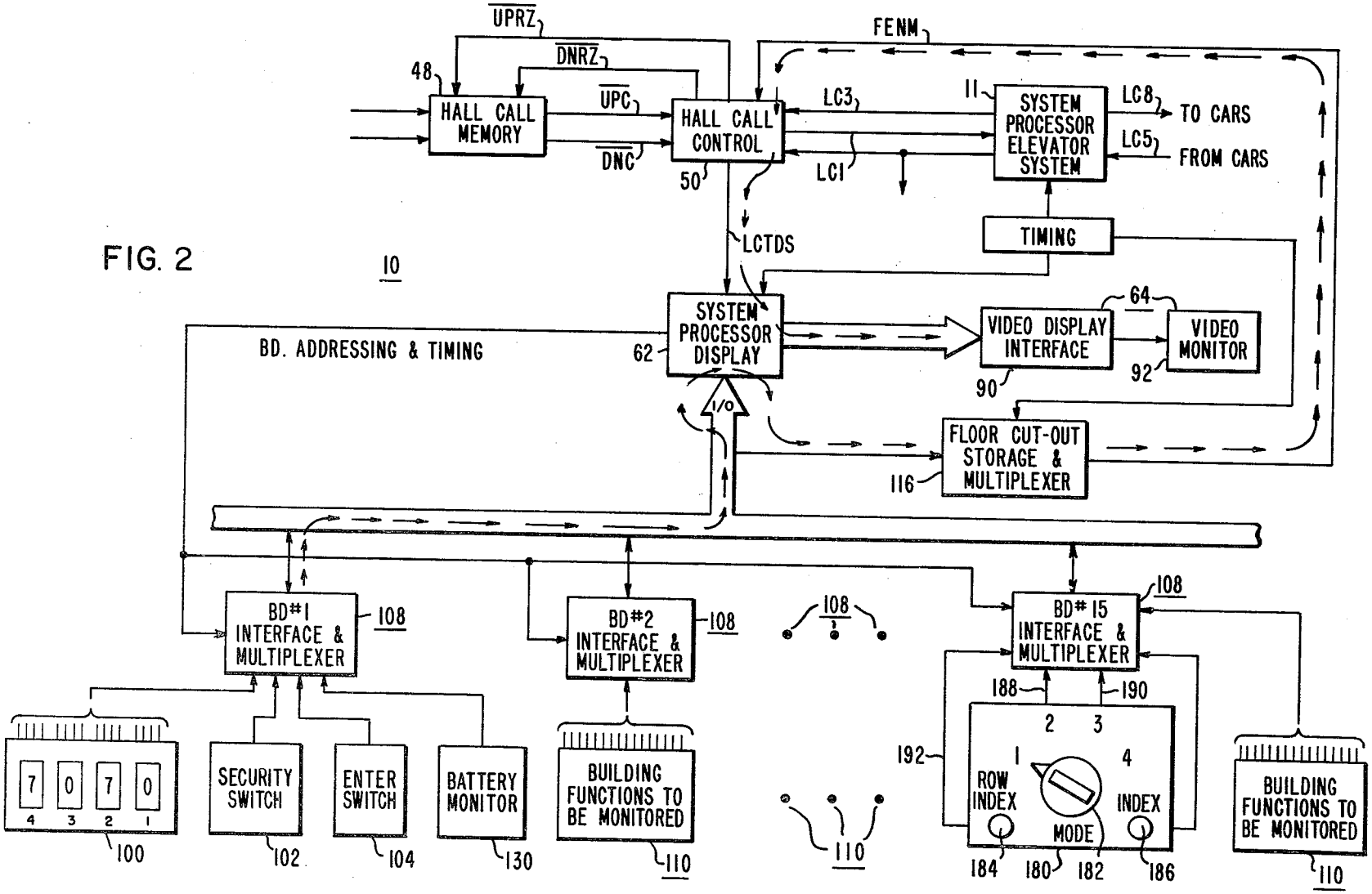
FIG. 2 is a partially schematic and partially block diagram which expands upon certain of the functions illustrated in FIG. 1.

Referring now to the drawings, and to FIGS. 1 and 2 in particular, there is shown an elevator system 10 constructed according to the teachings of the invention. In order to limit the complexity of the present application, the following United States patents, which are assigned to the same assignee as the present application, are hereby incorporated by reference. These United States patents describe in detail an elevator system which may utilize the teachings of the invention, and thus FIGS. 1 and 2 illustrate these functions in block form:

(1) U.S. Pat. No. 3,750,850
(2) U.S. Pat. No. 3,804,209
(3) U.S. Pat. No. 3,851,733

Elevator system 10 includes a plurality of elevator cars under the control of a supervisory system processor 11. For purposes of example, only one elevator car 12, associated with a control A, is illustrated, since the others would be similar. Elevator control A includes a floor selector and car controller 14 mounted in the associated elevator car. The car station includes a push button array, such as push button array 30 illustrated in elevator car 12, for passengers to register car calls, i.e., their destination floors. The car calls are serialized in car station 22 and sent to the associated floor selector 14 as signal $\overline{\text{PREAD}}$. Car call resets are sent from the floor selector 14 to the car station 22 as serial signal $\overline{\text{PCCR}}$.

The elevator cars are mounted for movement in a building to serve the floors therein. For example, car 12 is mounted in a hoistway 32 of a building 34 having a plurality of floors or landings. For purposes of example, it will be assumed that building 34 has twenty-six floors, with only the lowest floor B, the highest floor TE, and intermediate floors 1 and 24 being shown in FIG. 1.

The car 12 is supported by a plurality of wire ropes 34 which are reeved over a traction sheave 36 mounted on the shaft of a drive motor 38. Drive motor 38 also includes suitable controls, shown generally within block 38. A counterweight 40 is connected to the other ends of the ropes 34. A traction elevator system is illustrated in FIG. 1 for purposes of example, but it is to be understood that the invention applies equally to any type of elevator system, such as an elevator system which is hydraulically operated.

Hall calls are registered by push buttons mounted in the hallways adjacent to the floor openings to the hoistway. For example, the lowest floor B includes an up push button 42, the highest floor TE includes a down push button 44, and the intermediate floors each include up and down push button assemblies 46. The up and down hall calls registered on these push buttons are sent to hall call control 50 as signals $\overline{\text{UPC}}$ and $\overline{\text{DNC}}$, respectively.

Hall call control 50 sends the hall calls to the system processor 11 as part of serial signal LC1. The system processor 11 prepares assignments for the various elevator cars and sends individual assignment words to each car controller and floor selector via signals LC8. Each car controller and floor selector 14 prepares status words for the system processor 11, which are sent to the system processor as signals LC5. The system processor 11 prepares reset signals for the hall call control and sends the resets to the hall call control as part of a signal LC3. Hall call control 50 sends up and down resets $\overline{\text{UPRZ}}$ and $\overline{\text{DNRZ}}$, respectively, to the hall call memory 48. Clock and synchronization signals LCC and LCS, respectively, are prepared by the system processor 11 and sent to the various control functions, to properly control transfer of data between the functional blocks. The incorporated patents explain the timing and the makeup of the various serial signals in detail.

Hall calls registered on push buttons 42, 44 and 46 at the various floors are displayed at a selected location, such as at a traffic director station 60, hereinafter referred to as TDS 60, located in the lobby or the main floor. In a preferred embodiment of the invention, TDS 60 includes a microprocessor 62 and a video display 64. It is to be understood, however, that the display 64 may be any suitable type of display, such as light emitting diodes (LED's), liquid crystals, and the like. Further, instead of using a microprocessor, the processing portion of the display may be hardwired logic, minicomputer or other means of computation. The microprocessor 62 and video display 64 is an attractive combination as it facilitates the use of TDS 60 as a universal message center for the building 34, which may be easily tied into the building security system.

For purposes of example, the microprocessor 62 will be assumed to be Intel's 8080, but any suitable microprocessor or digital computer may be used. Microprocessor 62 includes an input port 70 (Intel's 8212), a system controller 72 (Intel's 8228), a central processor or CPU 74 (Intel's 8080A), a clock generator 76 (Intel's 8224), a read only memory 78, also referred to as ROM 78 (Intel's 8708), a random access memory 80, also referred to as RAM 80 (Intel's 8120A-4), and output ports 82, 84, 86 and 88 (Intel's 8212). An I/O decoder (Intel's 8205) (not shown), would be used between the CPU, PROMS, RAMS, and ports to handle the addressing.

In the elevator system of the incorporated patents, the data for TDS 60 would be sent over a serial data link, which is referenced LCTDS. This serial data may be demultiplexed eight bits at a time for entry into input port 70 via a counter 94 (Texas Instruments SN 74191) and a shift register 96 (Texas Instruments 74199). Counter 94 is reset by a synchronization signal LCS from the system processor 11, and clocked via a clock signal LCC from the system processor. The clock signal LCC also clocks the shift register to clock the serial data contained in signal LCTDS into the eight bit shift register 96. Each time counter 94 reaches a count of 8, it outputs a signal to input port 70 which provides an interrupt signal for CPU 74, to notify the CPU that the input port should be read. The eight bits of input data are then transferred to predetermined addresses in RAM 80. The information in RAM 80 is processed according to a program stored in ROM 78, and the resulting information is stored in RAM 80 until it is ready to be read out to the video display via the output ports 82, 84, 86 and 88. If the program for the microprocessor allows sufficient time, the demultiplexing function may be performed entirely within the microprocessor, in which event the shift register 96 and counter 94 would not be required.

Figure 3:
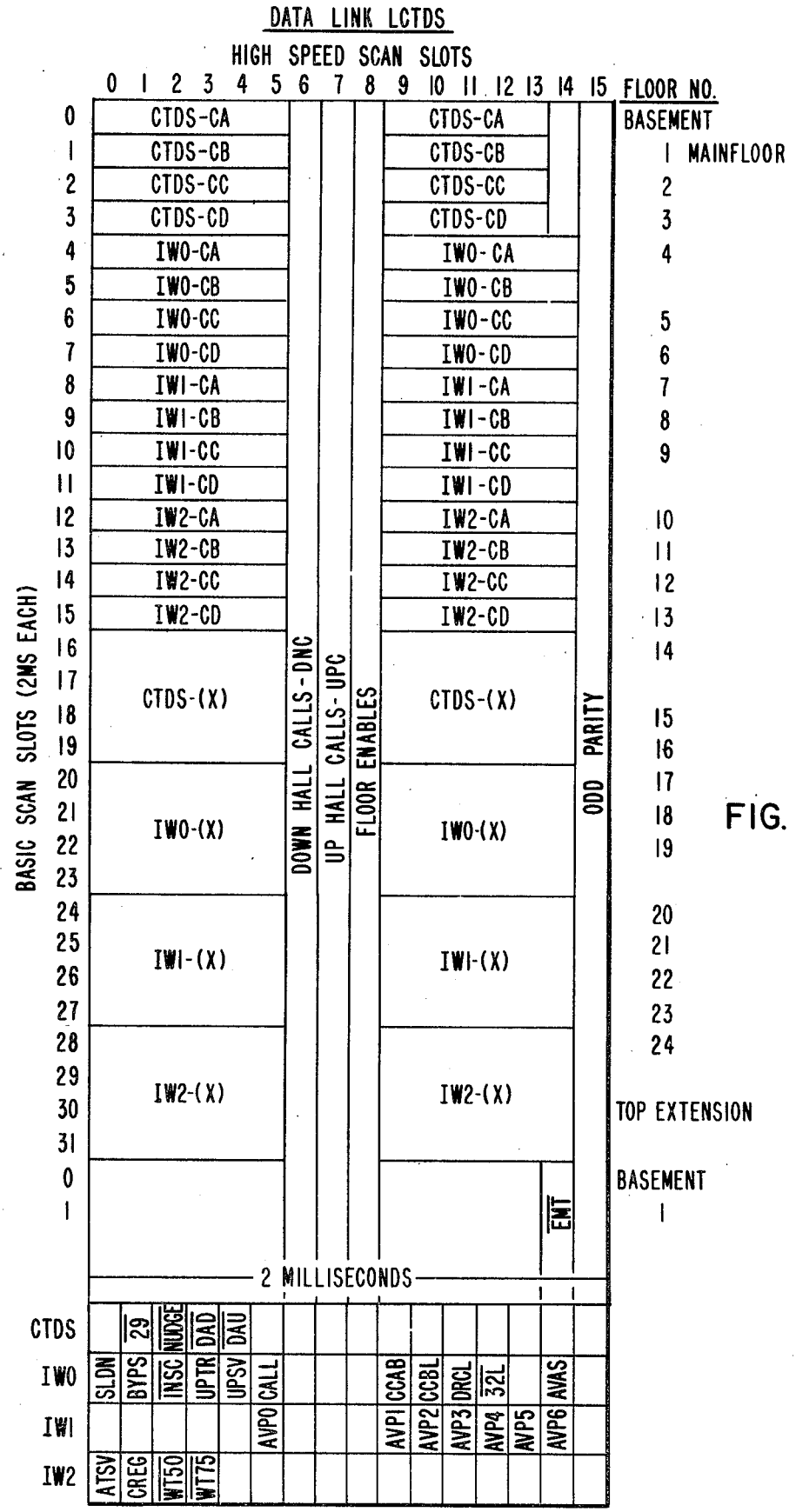
FIG. 3 is a graph which illustrates the information transferred in a data link shown in FIGS. 1 and 2, between certain control functions of the elevator system and a display function.

FIG. 3 illustrates a data link map for the data link LCTDS which links hall call control 50 and shift register 96. The data link map illustrates basic timing scan slots vertically along the lefthand side, which scan slots are developed by a scan slot counter output S0S-S6S in the elevator system incorporated by reference. The subdivision of each of the basic scan slots is shown horizontally under the heading "High Speed Scan Slots".

For purposes of example, it will be assumed that each of the basic scan slots exists for two milliseconds. Each basic scan slot is divided into sixteen bits by the high speed scan.

Each floor of the building to be served by the elevator system is assigned to one of the basic scan slots. The number of floors plus the number of scan slots required to identify express zones, and the like, determines how high the scan counter should be programmed to count before resetting to zeroes. For purposes of example, it will be assumed that the data link map is associated with a structure having twenty-six floor levels, which includes a basement floor B, floors numbered 1 through 24, and a top extension floor TE. Thus, the scan counter may be programmed to count from 0 to 31 in binary before resetting, which provides six scan slots which may be used for express zone information, or other uses. Each of the floors of the structure is assigned a binary address of the scan counter. When the scan counter is outputting the address of a specific floor, a car call for that specific floor will appear in that basic scan slot. During the same address of the specific floor, the high speed scan will output a plurality of bits of information relative to this same floor. Thus, when the scan counter output is 01001, scan slot 9, which in the example of FIG. 3, is the binary address of the eighth floor, data concerning the eighth floor is transmitted over both the low speed and high speed time multiplex links.

Data for the traffic director station 60 may include car status data in certain of the high speed scan slots, such as slots 0 through 5 and 9 through 14, one of the slots may be used to check parity, such as slot 15, and certain of the slots may be used for down hall calls $\overline{DNC}$, up hall calls $\overline{UPC}$, and floor enable signals, such as slots 6, 7 and 8, respectively. Thus, when the basic scan slot 9 exists, a down hall call $\overline{DNC}$ for the eighth floor will appear in the sixth high speed scan slot, and an up hall call $\overline{UPC}$ for the eighth floor will appear in the seventh high speed scan slot. Floor enable signals may appear in high speed scan slot 8, during the appropriate basic scan slot.

Exemplary data words which may be sent to TDS 60 for display are illustrated at the bottom of the data link map LCTDS shown in FIG. 3. The per car data may include the three input data words IW0, IW1 and IW2 prepared by each car controller for transmission to the system processor 11, and an additional data word CTDS. Data words CTDS for four cars A, B, C and D, for example, may be sent during basic scan slots 0, 1, 2 and 3. In like manner, the first input data word IW0 from the four cars may be sent during the four basic scan slots 4, 5, 6 and 7. The second input data word IW1 may be sent during the next four basic scan slots 8, 9, 10, and 11, and the third input data word IW2 may be sent during the four basic scan slots 12, 13, 14 and 15. The data words are then repeated in the same order.

The signals in the data words shown in FIG. 3, and the information they convey, are tabulated in the incorporated patents, as well as in the hereinbefore mentioned copending application Ser. No. 796,497, and will not be repeated here as they are not part of the present invention.

Figure 4:
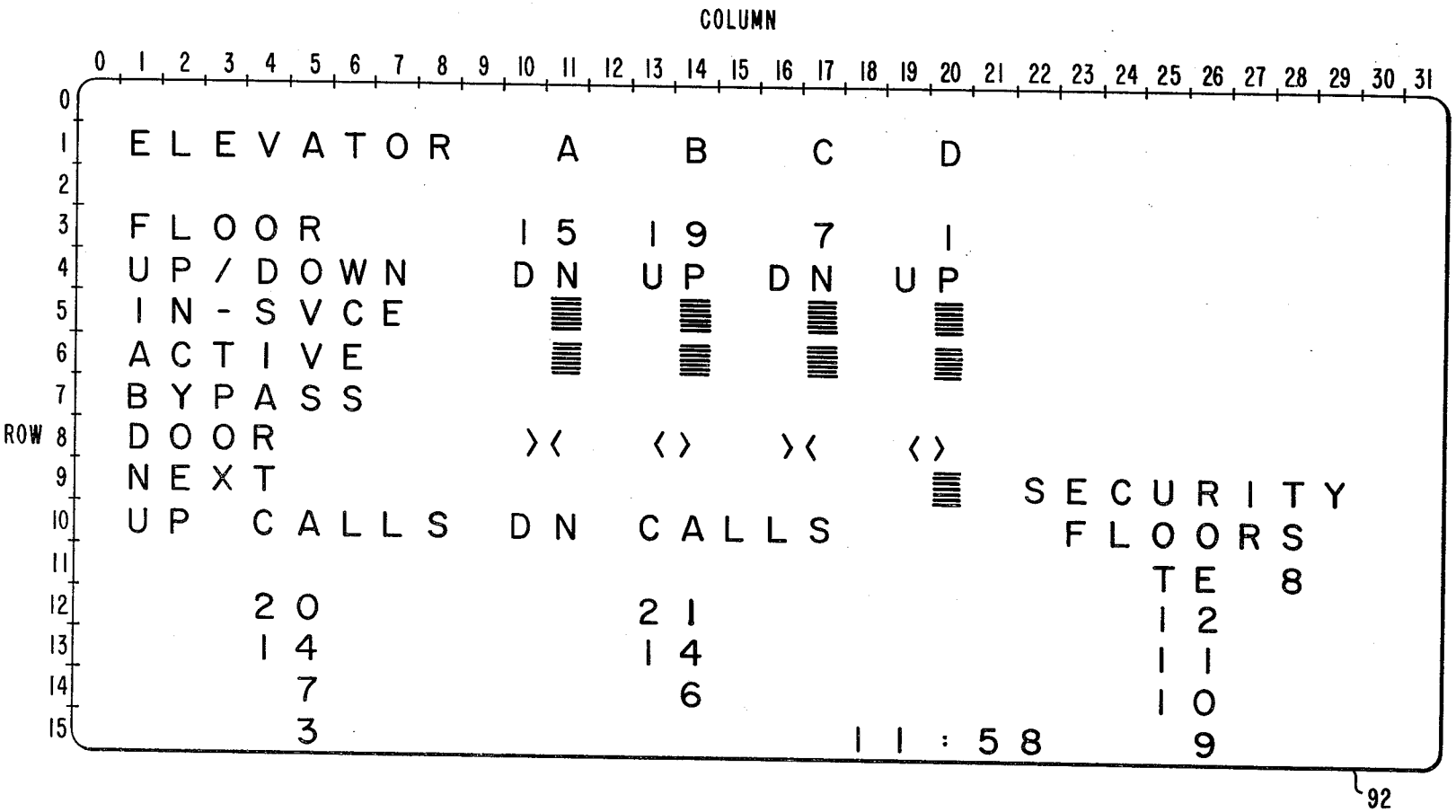
FIG. 4 is a schematic diagram of a portion of the car control for an elevator car, illustrating how master floor enable signals may be used to enable, or block, elevator service to a selected floor.

FIG. 1 illustrates TDS 60 with a video display 64 which includes a video RAM display interface 90 and a video monitor 92. For purposes of example, it will be assumed that the video display interface 90 is the CRT controller MTX-1632, manufactured by MATROX Electronic Systems of Montreal, Quebec. The video monitor may be Model EVM-1410, manufactured by Electrohome Ltd., Kitchener, Ontario. The MTX-2480 has a 16×32 display field for displaying thirty-two columns and sixteen rows of ASCII font characters. The display screen organization is illustrated in FIG. 4. Representatitve per car data for four cars A, B, C and D is illustrated, as well as registered up and down hall calls.

Returning now to FIG. 1, an exemplary embodiment of the present invention includes a building floor security function which includes four ten-position BCD switches 100, a keyed security switch 102, an enter push button or switch 104, a keyed override switch 106 and associated interface 107, and an interface and multiplexing function 108. Each ten-position BCD switch has four output conductors whose conditions correspond to the selected decimal number on the switch. For example, if the number 0 is selected on the switch, the four output conductors would each indicate a logic zero. The logic zero, for example, may be initiated by an open contact in the switch. If the number 9 is selected, for example, the four outputs would indicate the binary equivalent of 9, or 1001. The logic ones, for example, may be initiated by a closed contact in the switch. The switch contacts are connected in parallel to multiplexer function 108 which includes the necessary high voltage to low voltage interface. Thus, the four-10 position BCD switches may select a decimal, and thus a binary, code having 10,000 different combinations. Certain of these combinations are selected to cut-out or remove floors from elevator service, and certain are selected to return a cut-out floor to elevator service. Each floor would have its own unique code for removing it from elevator service, and its own unique code for returning it to elevator service. With 10,000 combinations to choose from, it would be difficult for unauthorized personnel to randomly re-enable a floor which had been removed from elevator service. Different codes may be used to take cars out of service, bring cars into service, change dispatching floors, etc.

The security switch 102 is a spring-loaded, key operated switch which must be turned and held to an "on" position in order to render the floor security function operative.

The enter push button 104 must be actuated while the security switch is "on", in order to enter the code dialed by the four-ten position switches 100.

The interface and multiplexer 108 is connected to input port 70 of the microprocessor 62. Other building functions monitored by switch contacts 110 are connected to multiplexer function 108. The switch contacts 110 have one of two positions or conditions. The condition of each is periodically read from the multiplexer function 108 by the processor 62 and decoded. A certain one of the two conditions of each switch initiates the display of an associated building message on the video monitor 92. For example, one of the switch contacts may be in an open condition when a predetermined fire alarm is in its normal state. Tripping of the fire alarm closes this contact, and this closed contact is decoded to initiate the display of a legend "Fire Alarm No. X Tripped". The code and associated legend are stored in a ROM look-up table in the processor.

Operation of the security switch 102 is noted by the processor 62 and decoded to override the display of any other currently activated building messages on the video monitor 92, and it initiates the display of a legend such as "Security Floors". Also, below this legend, all floor numbers which are currently cut-out or removed from elevator service are displayed. The video monitor 92, shown in detail in FIG. 4, illustrates how this legend might appear, along with an exemplary listing of cut-out floors. The "security floor" legend and the cut-out floors are maintained on the video monitor as long as the security switch 102 is held in the "on" position.

The operation of the security switch 102 also alerts the processor 62 to look for the actuation of the enter push button 104. When the enter push button 104 is actuated, the change in the condition of its associated contact is noted, and the processor 62 reads the code currently dialed by the four-ten position switches 100. The code is decoded in ROM 78 of processor 62, and the decoded floor along with the information concerning whether this floor is to be removed from elevator service, or to be returned to elevator service, is sent to an output port 114 of the processor 62. If desired, a predetermined number of attempts to enter an "incorrect" code, may trigger an annunciator or alarm.

Output port 114 provides address information for reading the multiplexers of the multiplexer function 108. It also provides a data transfer signal XFR for a comparator function 115, a floor cut-out signal FCO and a timing signal CLK for storage function 116, and a signal PF for a "watchdog" timer 113.

Storage function 116 includes a shift register 120 and storage flip-flops or latch 122. Signal FCO is applied to the serial data input terminal of shift register 120, and the timing signal CLK clocks the serial floor cut-out data contained in signal FCO into the shift register. The parallel data outputs of shift register 120 are applied to the data inputs of latch 122.

In addition to its data inputs, latch 122 includes a strobe input ST and an output enable input OE. When the strobe input ST goes high, the data in shift register 120 is strobed into latch 122.

The output of latch 122 will indicate the various conditions of its flip-flops, as long as its output enable input OE is high. Thus, input OE may be used as a "reset", to reset or wipe-out all floor cut-outs.

A battery 117 is used to keep alive certain volatile memories during a power outage. The condition of battery 117 may be monitored by a battery monitor 130. If the battery 117 is sufficiently charged, monitor 130 applies a logic one to an input of a three input NAND gate 119. Another input is connected to the output of the "watchdog" timer 113, and the remaining input is connected to the keyed override switch 106 via interface 107. The output of NAND gate 119 is inverted by NOT gate 121 and applied to input terminal OE of latch 122. Thus, if the battery is low, or if the processor 62 malfunctions and does not reset timer 113 on the required periodic basis, or if the override switch 106 is actuated, a low ENABLE signal will be applied to latch 122, to desable the outputs. A low battery on power turn-on indicates the information stored in volatile memories may not be accurate, and thus the floor cut-outs should be reset. When the processor 62 fails, it would also be desirable to reset the floor cut-outs; thus, the watchdog timer 113. It would also be desirable to reset the floor cut-outs during an emergency, such as a fire; thus the keyed override switch 106. As indicated in FIG. 1, the output of battery monitor 130 may also be connected to multiplexer function 108. A low battery signal may be decoded to place the message "change battery" on the video monitor 92.

Battery monitor 130 also provides a +12 volt reference voltage for comparator 115. The output of comparator 115 is connected to input terminal ST of latch 122. Comparator 115 compares the normal +5 volt power supply with the reference voltage. If the normal supply voltage is at least 4.75 volts, it is safe to assume that the data in shift register 120 is accurate, and the signal XFR from output port 114 will be allowed to pass to the strobe input ST of latch 122 as signal XFRM. Signal XFRM, when high, strobes the information in shift register 120 into the latch 122. The shift register 120 and latch 122 may be RCA's CD 4094, for example.

Multiplexer 124, on command from appropriate timing and sync signals, reads the floor, cut-out storage flip-flops 122, providing a serial master floor cut-out signal FENM. Serial signal FENM is connected to hall call control 50 where it is incorporated into the data assembled and transferred to the system processor via data link LC1, which in turn sends the floor enable signals to the various elevator cars via dta link LC8.

If it is desired to control other elevator related functions via the code switches 100, additional flip-flops may be provided for controlling these functions in latch 122. For example, as illustrated in FIG. 1, flip-flops may be provided for taking elevator cars out of service when the flip-flops are in a selected one of their conditions. These flip-flops would be connected to a low voltage to high voltage interface 123, and interface 123 wuld drive service request relays 125. A service request relay would be connected to the floor selector and car controller of each elevator car such as controller 14 for elevator car A. When a flip-flop in latch 122 is in one condition, the associated relays will be in a condition which requests that the associated elevator car be taken out of service. When the flip-flop is in its other condition, the associated relay will be in a condition which requests that the elevator car be inservice.

A change in the service condition of an elevator car will result in a change in the logic level of its signal INSV, which is sent to the system processor 11, to the hall call control 50, and finally to the display in signal LCTDS. This change will be noted on the display 92 shown in FIG. 4.

It is important to note that the indication adjacent to legend "IN-SVCE" on display 92 of FIG. 4 is responsive only to signal LCTDS, and not to the request initiated by the code switches 100 as applied to multiplexer function 108. Thus, a change in the display confirms that the command has been received and it has been carried out.

Figures 5, 7:
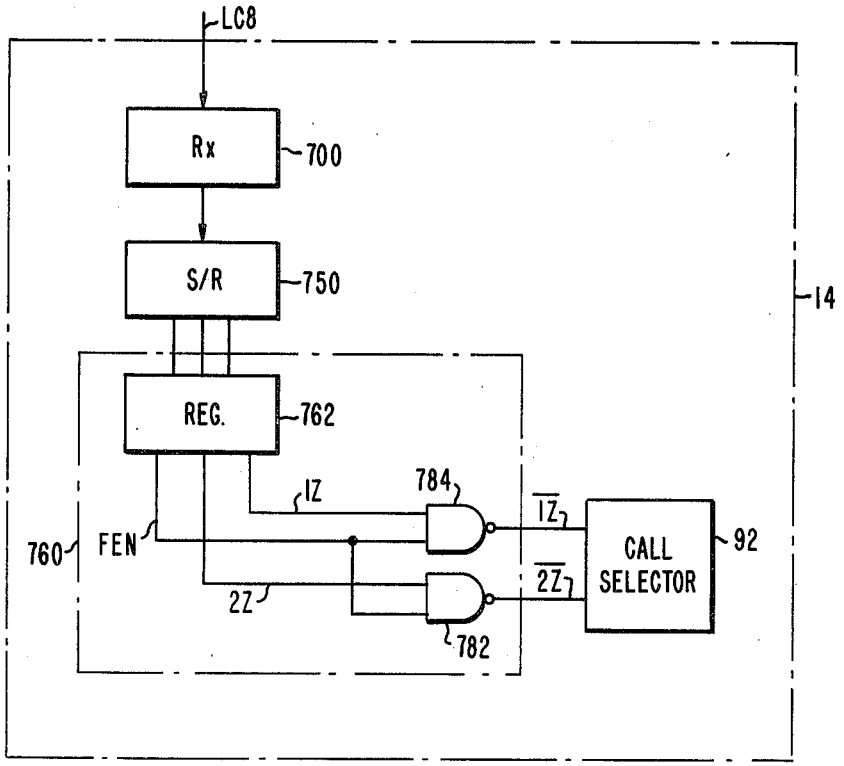
FIG. 5 is an elevational view of a video monitor which may be used in the display shown in block form in FIGS. 1 and 2, which illustrates the display of security floors according to an embodiment of the invention.
FIG. 7 is a ROM map, illustrating how the input code for cutting-out and enabling floors of a building may be decoded to identify the intended floor.

FIG. 5, which is taken from FIGS. 15, 24 and 26 of incorporated U.S. Pat. No. 3,804,209, illustrates how the floor enable signals FEN applied to each elevator car, when they go low, block the up and down hall calls 1Z and 2Z from consideration by the call selector 92. The serial data link LC8 is received by a receiver 700 in the floor selector and car controller 14, and it is clocked into a shift register 750. Three bits are removed from shift register 750 and held in a three-bit register 762, with these three bits being the serial up calls 1Z, the serial down calls 2Z, and the floor enable signal FEN. When the floor associated with the instant scan slot is enabled, signal FEN will be high, enabling NAND gates 784 and 782 to pass an up hall call $\overline{1Z}$, or a down hall call $\overline{2Z}$ into the call selector 92. When the floor being scanned is cut-out, signal FEN will be low, blocking a true up or down hall call from driving the output of NAND gates 784 or 782 low. Thus, a hall call in this scan slot is not passed on to the call selector 92. Car calls may be blocked from consideration in the same manner.

The floor enable signals in the master serial signal FENM are also sent to the microprocessor 62 via the data link LCTDS, and the cut-out floors are displayed as illustrated in FIG. 4. Again, it is important to note that the floors cut-out are displayed only in response to signal LCTDS, and not in response to receiving a floor cut-out signal from multiplexer 108. Thus, the display confirms that a floor cut-out has been received by the elevator system, and also that a floor returned to elevator service, after it had been cut-out, has been received by the elevator system and has actually been returned to elevator service. FIG. 2 illustrates this flow of information by the arrows. A code entered by security switch 102 and enter switch 104 goes to the microprocessor 62 for decoding, and the decoded information is applied to the floor cut-out storage 116. The information stored in storage 116 is sent to the hall call control 50, which in turn sends it to the display microprocessor 62 via signal LCTDS. The floor cut-out information is removed from signal LCTDS for display. The security officer will thus receive visual confirmation that a floor cut-out has been correctly entered and received, as it will appear on the video monitor. A floor restored to service, after it has been cut-out, will be removed from the video monitor, again confirming to the security officer that the cut-out floor has been returned to elevator service.

A real time or time of day clock 132 may also be provided, as shown in FIG. 1. Clock 132 may be powered by battery 117. Clock 132 may be used to disable and re-enable selected floors, take cars into and out of service, etc., automatically with the clock, at predetermined times of the day and/or predetermined times of the week, or both. This clock control may supplement the manual control via the security switch, code switches, and enter switch. The clock 132, for example, may be programmed to automatically select predetermined contact closures which would remove predetermined floors from elevator service, or return predetermined floors to elevator service. As illustrated in FIG. 4, the time of day clock 132 may also be used to provide a continuous indication on the video monitor 92 of the correct time. This also provides a visual confirmation that the clock 132 is correctly set.

Figure 6:
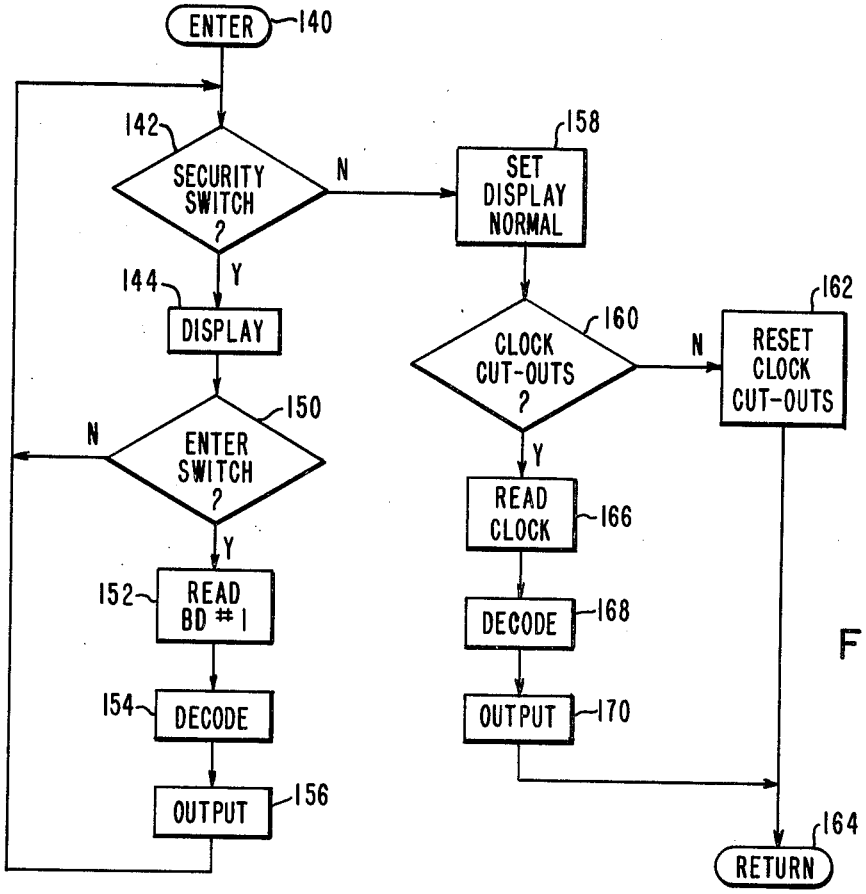
FIG. 6 is a flow chart which illustrates the basic steps of a program for implementing a floor security aspect of the invention.

FIG. 6 is a flow chart which sets forth the basic steps in programming the microprocessor 62 to cooperate with the floor security hardware shown in FIGS. 1 and 2. The floor security program is entered at 140 and the first step 142 of the program checks the conditions of the security switch 102. If it is actuated, step 144 wipes out any building messages currently being displayed on the video monitor, and it immediately displays the legend "Security Floors", along with the floor numbers of the currently cut-out floors. See the video monitor shown in FIG. 4 for an exemplary security floor display.

The program then advances to step 150 which checks the condition of the enter switch 102. If the enter switch 102 is not actuated, the program returns to step 142. If the enter switch is actuated, step 152 reads multiplexer board No. 1, referenced 108 in FIGS. 1 and 2, reading the code into RAM 80 of FIG. 1. Step 154 decodes the code provided by the four-ten position switches 100 by referring to the code look-up table in ROM 78 of FIG. 1.

FIG. 7 illustrates a ROM map which gives examples of floor disable and floor enable codes for a few of the floors of the building. For example, if the top extension floor TE is to be disabled or removed from elevator service, the code 7070 would be dialed on the four switches 100, as illustrated in FIG. 2. When the security switch 102 and enter switch 104 are both simultaneously actuated, the code 0111 0000 0111 0000 would be read into RAM 80, and this code would be compared with the codes of the look-up table shown in FIG. 7. This code would be recognized as the disable code for the top extension floor, and step 156 would send this decoded information to output port 114 of the microprocessor 62. The "floor cut-out" for the top extension would be stored in the storage flip-flops 122, where it would be periodically read into the hall call control 50 for incorporation into the data links LCTDS, LC1 and LC8, as hereinbefore described.

Figure 9:
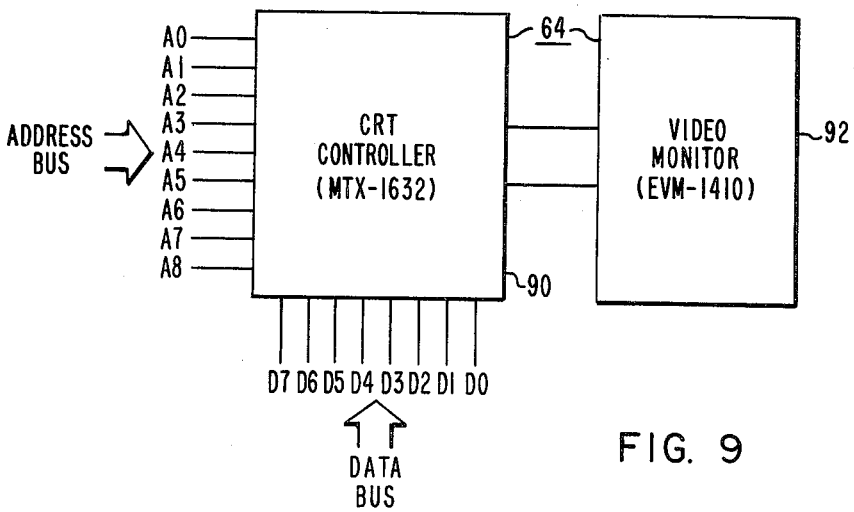
FIG. 9 is a diagram of a CRT controller and video monitor which may be used for those functions shown in FIGS. 1 and 2.
Figures 8, 12:
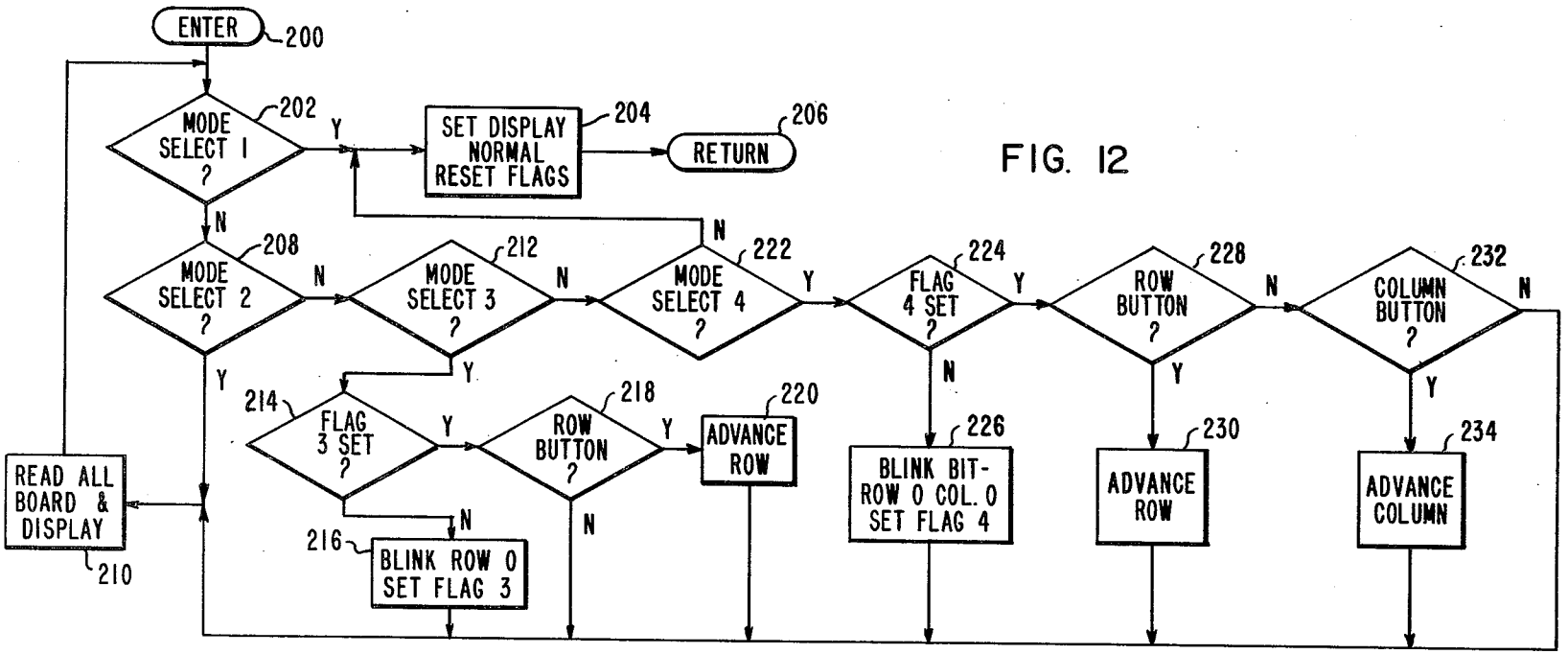
FIG. 8 is a RAM map illustrative of the development and storage of the address and data for the video RAM and associated monitor shown in FIGS. 1 and 2.
FIG. 12 is a flow chart which illustrates the basic steps of a program for implementing the multiple display modes according to the teachings of the invention.

The floor cut-outs are removed from data link LCTDS and displayed. FIG. 8 is a RAM map which illustrates the preparation of the address and data for the display 64. FIG. 9 illustrates the address and data inputs of the CRT controller 90 (MTX-1632) used as an example in the embodiment of FIG. 1. The CRT controller 90 has an 8-bit data bus input, D0 through D7, and a 9-bit address bus input A0 through A8. As illustrated in FIG. 4, the letter "T" appears in the eleventh row and twenty-fifth column. Thus, as illustrated in FIG. 8, the address for the left-hand bit of the legend TE is 1011 for the row, and 11001 for the column. From the ASCII character font of the MATROX MTX-1632, the letter T is represented by row 101 and column 0100. Thus, 101 appears at D6, D5 and D4, respectively, of the RAM map, and 0100 appears at D3, D2, D1 and D0, respectively. Bit D7 is a zero, unless it is desired to blink this bit, in which case it would be a one.

In like manner, the address or location of the letter E on video monitor 92 of FIG. 4 is row 11 and column 26. Thus, 1011 appears in FIG. 8 as the row address for the righthand bit of the legend TE and 11010 appears as the column address for the righthand bit. The letter E has a row and column address of 100 and 0101, respectively, in the ASCII character font, and these bits appear under the legends D6, D5, and D4, and D3, D2, D1 and D0. These bits are applied to the like labeled input terminals of the CRT controller 90 shown in FIG. 9.

When the legend TE appears on the display monitor 92, the security officer receives visual confirmation that the top extension has been removed from elevator service. When the security officer wishes to return the top extension to elevator service, the code 0504 is dialed on the floor security switches, the security switch 102 is turned to its "on" position with the security key, and the enter switch 104 is actuated. The removal of TE from the display confirms the correct administration of the security procedure, and the security key is then turned to the "off" position and removed.

The next time the security switch 102 is checked by step 142 of the FIG. 6 flow chart, it will find the switch is in its "off" position and the program advances to step 158 which returns the display to normal, i.e., it again decodes the inputs and it displays any associated building messages requested by the conditions of the switch contacts 110 which appear at the multiplexer 112 of FIG. 1.

After the display is set to normal by step 158, the program checks for automatic clock cut-outs in step 160, as initiated by the time of day clock 132 shown in FIG. 1. It will be noted that the clock 132 is checked each time the floor security program is entered, regardless of whether or not the security switch 102 is actuated. If there are no clock floor cut-outs requested, step 162 resets all clock cut-outs and the program returns to the main program at 164.

If step 160 finds the clock is ready to provide automatic floor cut-outs, step 166 reads the clock cut-out code, step 168 decodes the code by using the ROM look-up table shown in FIG. 7, step 170 outputs the decoded floor information to output port 114, and the program returns to the main program at 164.

In the normal display mode, the microprocessor 62 reads the conditions of the switch contacts at the multiplexer function 108, and decodes the switch conditions to determine what, if any, display should be prepared for the video monitor. In another aspect of the invention, the conditions of the switches are directly displayed without any decoding. This provides a powerful test and service tool as it enables the integrity of the wiring from each remote switch contact to the interface boards to be visually checked. For example, if it is assumed that an open switch contact results in a display of a "zero", and a closed switch contact results in a display of a "one", the wiring of a switch contact to the proper pin on the interface board may be checked by first noting the board number and pin number on the board. Since there are sixteen rows and thirty-two columns on the video monitor selected for purposes of example, sixteen boards, each having thirty-two pins for receiving information from thirty-two different switches may be accommodated. The output of board No. 1 would appear in row 0 of the monitor, the output of board No. 2 in row 1, etc. The thirty-two pins would appear in the thirty-two columns of these rows. Thus, if it is desired to check the integrity of the wiring of switch 20 of board No. 1, switch 20 is actuated between its open and closed positions and the location of switch 20 on the monitor is checked to see if the display is changing between 0 and 1 according to the switch openings and closings.

To aid in the visual location of the switch on the video monitor, an additional display mode is arranged to select a row and to blink all of the bits of the selected row. Still another display mode is arranged to select a single bit on the monitor and to blink this bit.

More specifically, a display mode select function is broadly illustrated in FIG. 1 with the reference 180. This function provides open and closed switch conditions which are read and decoded by the microprocessor 62 to implement the selected mode.

The display mode select function 180 is illustrated in greater detail in FIG. 2, with a four-position selector switch 182, a row index button or switch 184, and a column index button or switch 186. With the mode switch in position 1, the display is in the normal mode, i.e., it decodes the inputs represented by the open and closed external switch contacts, and it displays any associated message, which messages are stored in an appropriate ROM look-up table, as hereinbefore mentioned. Switch 182 may output the selection of the normal mode over conductors 188 and 190 as binary signal 00, i.e., as two open switch contacts.

Figure 10:
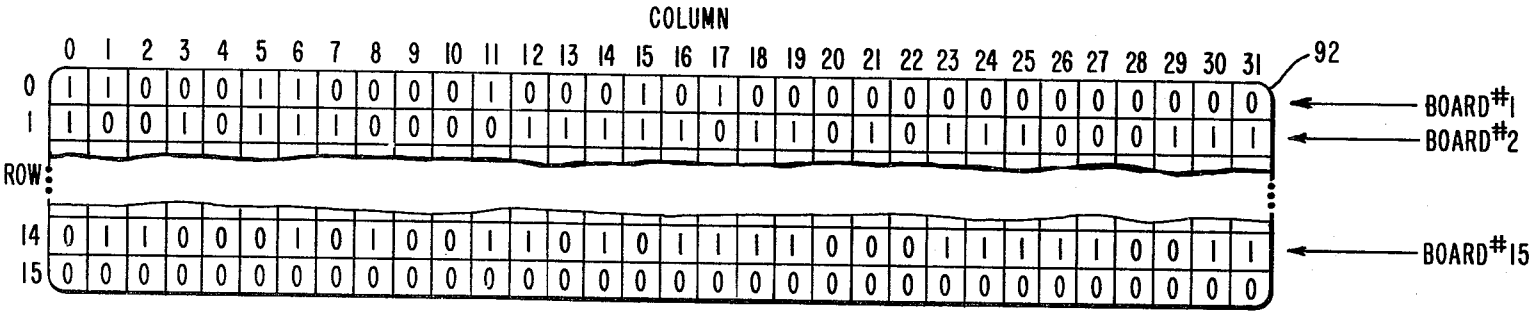
FIG. 10 is a fragmentary view of a video monitor which illustrates a display mode useful in testing and servicing the display apparatus of the invention.
Figure 11:
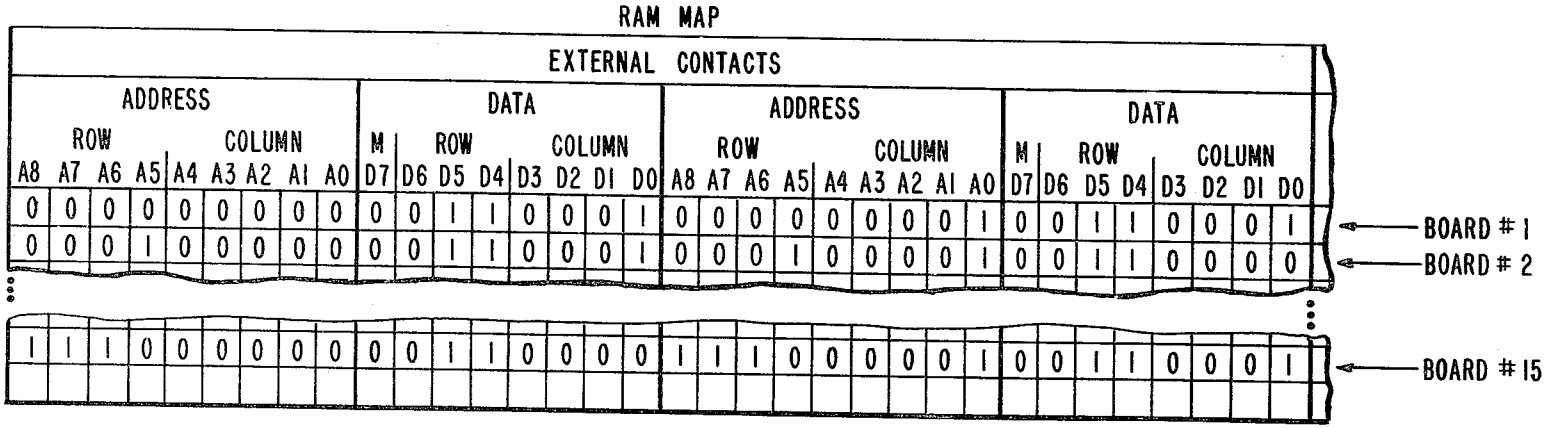
FIG. 11 is a RAM map which illustrates the addressing and associated data for developing the display mode shown in FIG. 11.

Advancing selector switch 182 to "mode 2" changes the conditions of the switch contacts associated with the conductors to indicate the binary signal 01, i.e., an open and a closed switch contact. This mode directly displays the conditions of the switch contacts which are connected to all of the interface and multiplexer boards 108 and 112. Fifteen boards are indicated in FIG. 2, but any number up to and including sixteen may be used. FIG. 10 is a fragmentary view of video monitor 92 illustrating an exemplary display of the conditions of the switch contacts connected to boards 1, 2 and 15. FIG. 11 is a RAM map which illustrates the preparation of the addresses and data for a few of the contacts shown in the display of FIG. 10.

Returning to FIG. 2, advancing the display mode select switch to position 3 outputs the binary signal 10 to board 15, i.e., a closed switch contact and an open switch contact, via conductors 188 and 190, respectively. In this mode, all of the conditions of the switch contacts are displayed as in mode 2, and additionally, all of the bits of row 0 are blinked on and off. This mode also enables the row index button 184. Each time button 184 is actuated, it advances the blinking condition to the next row, and it ceases the blinking of the previous row. The condition of the switch associated with button 184 is conveyed to board 15 via conductor 192. Thus, if the switches connected to board 15 are to be examined, button 184 is operated the necessary number of times to advance the blinking row to the row associated with board 15.

If it is desired to blink a single bit, the mode select switch is advanced to position 4, resulting in the closing of both switch contacts associated with switch 182, outputting the binary signal 11 to board 15 via conductors 188 and 190. This mode flashes the bit located in the first column of the first row, and it enables both the row index button 184 and the column index button 186. Actuating button 184 advances the blinking bit vertically downward from row to row. Once the desired row is reached, button 186 is actuated to advance the blinking bit from column to column, until the desired bit is blinking.

FIG. 12 is a flow chart which sets forth the basic steps of an exemplary implementation of the multiple display mode aspect of the invention. This portion of the program is entered at 200 and the condition of the mode select switch 182 is checked in step 202. If it is in position 1, step 204 sets the display to normal, i.e., to decode the switch inputs, it resets the program flags associated with the multiple mode function, and it returns to the main program at 206. If step 202 finds the mode select switch is not in position 1, step 208 determines if it is in position 2. If it is, step 210 reads all of the external boards and directly displays the conditions of the switch contacts connected thereto, as shown in FIG. 10. The program returns to step 202 and it stays in the loop which includes steps 202, 208 and 210 as long as switch 182 is position 2. When step 208 finds that switch 182 is not in position 2, step 212 checks to see if it is in position 3. If it is, step 214 checks to see if flag 3 has been set. Since this is the first time position 3 has been checked since entering the program, flag 3 wil not be set as all flags are reset in step 204 before this program is exited. Thus, the program advances to step 216 which blinks all of the bits in row 0, it sets flag 3 and advances to step 210 which reads the boards and displays the conditions of the associated switch contacts. The program returns to step 202 and advances back to step 214 which will now find flag 3 set. Step 218 looks for actuation of the row index button 184. If it is not actuated, the program stays in the loop which includes steps 210, 202, 208, 212, 214 and 218 until step 218 detects that the row index button has been actuated. Step 220 then advances the blinking row by one, i.e., instead of blinking row 0, it will now blink row 1, etc. The program will continue to recognize successive actuations of the row index button 184 until the blinking row contains the switch contacts, to be examined.

When step 212 finds that switch 182 is not in position 3, step 222 checks to see if switch 182 is in position 4. If it is not, the program returns to step 204, the display is returned to normal, and the program flags are reset.

If step 222 finds switch 182 in position 4, step 224 will check a flag referenced "flag 4". Flag 4 will not be set initially and the program advances to step 226 which blinks the single bit located in row 0, column 0, it sets flag 4, and it returns to step 210 to read the boards and display the contact conditions. The program returns to step 202 and this time when it reaches step 224, it will find flag 4 set. The row button 184 is then checked to see if it is actuated. If it is actuated, step 230 advances the blinking bit to the next row. If step 228 does not find the row button actuated, the column button 186 is checked in step 232 to see if it is actuated. If it is actuated, step 234 advances the blinking bit to the next column and returns to step 234. If the column button is not actuated, the program returns directly to step 234. The program stays in the loop which looks for actuated row and column indexing buttons as long as the program is in the mode selected by position 4. When step 222 finds that switch 182 is no longer in position 4, the program returns to step 204 which returns the display to normal, and resets the flags, and then exits at 206.

We claim as our invention:

1. An elevator system, comprising:

a building having a plurality of floors, an elevator car mounted in said building to serve the floors therein, call means for registering calls for elevator service, control means responsive to said call means for directing the movement of said elevator car to serve calls for elevator service registered on said call means, visual display means responsive to said call means and said control means for displaying selected dynamic parameters of the elevator system, building floor security means providing a plurality of signals, with each of said signals being in a selected one of two conditions, said building floor security means including first means for selecting the conditions of its signals to provide a floor cut-out signal for a selected floor, and memory means for storing each floor number for which a floor cut-out signal is generated, said control means being responsive to said memory means for preventing elevator service to the cut-out floors in response to said call means, said security means including second means operatively connected to said display means for selectively causing said display means to visually display the cut-out floors currently stored in said memory means.

2. The elevator system of claim 1 wherein the signals provided by the building security means are applied to the display means, the display means includes decoding means for decoding the conditions of the signals to identify the floor cut-out, and the memory means is responsive to the display means.

3. The elevator system of claim 1 wherein the control means receives signals responsive to the floors cut-out from the memory means, and the visual display means receives signals responsive to the floors cut-out from the control means.

4. The elevator system of claim 1 wherein the signals provided by the building security means are applied to the display means, the display means includes decoding means for decoding the conditions of the signals to identify the floor cut-out, the memory means is responsive to the display means, the control means receives the floors cut-out from the memory means, and the visual display means receives the floors cut-out from the control means.

5. The elevator system of claim 1 wherein the second means of the building security means enables the floor cut-out function, and the first means selects the floor to be cut-out, and wherein the building security means includes third means for entering the floor cut-out selected by the first means while the second means is enabling the function.

6. The elevator system of claim 1 wherein the first means of the building security means includes means for providing a master reset signal which resets all floors previously cut-out.

7. The elevator system of claim 1 including means providing a plurality of signals responsive to predetermined parameters of the building, the visual display means includes decoding means for decoding the plurality of signals and for displaying predetermined building messages in response thereto.

8. The elevator system of claim 7 wherein the second means of the security means terminates the display of any building messages when it is operated to cause the display means to display the cut-out floors.

9. The elevator system of claim 1 wherein the building security means includes reset means operatively connected to reset the memory means when selectively operated, to cancel all of the floor cut-outs stored therein.

10. The elevator system of claim 1 wherein the second means, in addition to causing the display means to display the cut-out floors, enables the floor cut-out function, and the first means selects the floor to be cut-out, and wherein the building security means additionally includes third means for entering the floor cut-out selected by the first means, and wherein the display means changes the display to include the newly added cut-out floor after the memory means stores the number of the floor cut-out.

11. The elevator system of claim 1 including means for selecting one of at least two display modes for the visual display means, with one of the display modes including means decoding the input signals of the building security means, and the other of the display modes directly displays the conditions of the input signals.

12. The elevator system of claim 1 including monitor means providing a plurality of signals responsive to predetermined parameters of the building, with each of said signals being in a selected one of two conditions, the visual display means includes decoding means for decoding the plurality of signals, and means for displaying predetermined building messages in response thereto, and including means for operating the display means in an additional mode in which the conditions of the plurality of signals are visually displayed without decoding.

13. The elevator system of claim 12 wherein the conditions of the plurality of signals are visually displayed in horizontal rows and vertical columns, and including means for blinking a predetermined row of the signals.

14. The elevator system of claim 12 wherein the conditions of the plurality of signals are visually displayed in horizontal rows and vertical columns, and including means for blinking a predetermined signal at the intersection of a predetermined row and predetermined column.

15. The elevator system of claim 1 wherein the visual display means includes a video monitor.

16. The elevator system of claim 1 wherein the first means of the building floor security means is operable to select the conditions of its signals to provide a signal which will take the elevator car out of service, the memory means stores this out of service signal, the control means is responsive to the memory means to take the elevator car out of service, and wherein the security means includes means operatively connected to the display means for selectively causing said display means to visually display the service condition of the elevator car currently stored in the memory means.

* * * * *